US008284111B2

(12) United States Patent
Chakam et al.

(10) Patent No.: US 8,284,111 B2
(45) Date of Patent: Oct. 9, 2012

(54) MULTIPART ANTENNA WITH CIRCULAR POLARIZATION

(75) Inventors: Guy-Aymar Chakam, Regensburg (DE); Andreas Schäfer, München (DE); Martin Weinberger, München (DE)

(73) Assignee: Continental Automotive GmbH, Hannover (DE)

( * ) Notice: Subject to any disclaimer, the term of this patent is extended or adjusted under 35 U.S.C. 154(b) by 354 days.

(21) Appl. No.: 12/672,716

(22) PCT Filed: Jul. 30, 2008

(86) PCT No.: PCT/EP2008/059987

§ 371 (c)(1),
(2), (4) Date: Mar. 12, 2010

(87) PCT Pub. No.: WO2009/019177

PCT Pub. Date: Feb. 12, 2009

(65) Prior Publication Data

US 2010/0194659 A1 Aug. 5, 2010

(30) Foreign Application Priority Data

Aug. 9, 2007 (DE) ..... 10 2007 037 614

(51) Int. Cl.
*H01Q 11/12* (2006.01)
*H01Q 21/00* (2006.01)

(52) U.S. Cl. ..... 343/742; 343/867; 343/895

(58) Field of Classification Search ..... 343/741, 343/742, 866, 867, 895
See application file for complete search history.

(56) References Cited

U.S. PATENT DOCUMENTS

| | | | | |
|---|---|---|---|---|
| 3,611,398 | A | 10/1971 | Schnetzer | |
| 4,502,053 | A | 2/1985 | Dupressoir et al. | |
| 5,136,303 | A * | 8/1992 | Cho et al. | 343/718 |
| 5,798,737 | A | 8/1998 | Kanaba et al. | |
| 5,990,849 | A | 11/1999 | Salvail et al. | |
| 6,710,752 | B2 | 3/2004 | Saito et al. | |
| 6,950,074 | B2 * | 9/2005 | Arisawa et al. | 343/748 |
| 2002/0190906 | A1 | 12/2002 | Kim et al. | |

FOREIGN PATENT DOCUMENTS

| | | | |
|---|---|---|---|
| EP | 0443491 | A1 | 8/1991 |
| EP | 0743699 | A1 | 11/1996 |
| EP | 1263081 | A2 | 12/2002 |
| GB | 2393855 | A | 4/2004 |
| WO | 9952178 | A1 | 10/1999 |
| WO | 0106596 | A1 | 1/2001 |
| WO | 03044892 | A1 | 5/2003 |

* cited by examiner

*Primary Examiner* — Hoang V Nguyen
(74) *Attorney, Agent, or Firm* — Laurence A. Greenberg; Werner H. Stemer; Ralph E. Locher

(57) ABSTRACT

An antenna apparatus has a first antenna branch and a second antenna branch. Both the first and the second antenna branch are in the form of a conductor loop which is not closed, and the first antenna branch is arranged at a distance from the second antenna branch in a direction which is substantially at right angles to the surface bounded by the respective conductor loop, such that the first loop direction, which is defined from the foot point to the free end of the first antenna branch, is arranged in the opposite direction to the second loop direction, which is defined from the foot point to the free end of the second antenna branch.

21 Claims, 5 Drawing Sheets

MULTIPART ANTENNA WITH CIRCULAR POLARIZATION

BACKGROUND OF THE INVENTION

Field of the Invention

The invention relates to an apparatus for sending and receiving electromagnetic waves and relates in particular to an antenna arrangement with circular polarization.

Radio-based access systems have how become the standard method of making controlled access to motor vehicles possible. These access systems primarily serve to enable the doors or trunk of a motor vehicle to be locked in a convenient manner, as well as allowing the immobilizer present in a motor vehicle to be activated and deactivated.

By integrating bidirectional communication into the radio transmission between the mobile radio station of the access system and distant end embodied in the motor vehicle as the on-board station, remote-control and remote-interrogation functions can be realized. It is thus possible to retrieve data relating to the status of the motor vehicle by means of the mobile station. Typically this is information about the fill level of the fuel tank, the tire pressure or the like. In addition bidirectional communication usually also offers the option of calling up further functions of the motor vehicle, such as enabling vehicle windows, sun roofs and sliding doors, but also any static heating present in the motor vehicle, to be controlled from longer distances.

There are a number of frequency bands available for the radio connection between mobile station and on-board station, which are predominantly to be found in the ISM (Industrial, Scientific and Medical) band. The frequency bands reserved for radio communication are not identical in all countries in such cases, so that the radio stations mostly have to be optimized for a number of frequency bands.

The services supported by the radio-based access systems require coverage ranging from a few meters (e.g. for closing the vehicle doors) up to a few hundred meters and possibly kilometers for remote interrogations. Specific services, such as the opening of the motor vehicle doors for example, can sometimes only be called up in such cases when the distance to the motor vehicle is less than a certain amount. Others, such as requesting the current time for which the vehicle has been parked, should be able to be performed over a distance that is as great as possible. The propagation conditions for the radio waves between the two stations of the access system are characterized in such cases by different parameters. Apart from the frequency range, said parameters are primarily the distance between the radio stations, the direction of polarization of the electromagnetic wave used for radio transmission, the type of antenna(s) fitted in or on the motor vehicle, the type of antenna(s) used in the mobile station, the orientation of the mobile radio station in the space as well as its position in the hand or on the body of the user and finally also the environment in the area of the radio connection path which can lead to a multipath propagation of the radio signals.

The antenna(s) of the radio station located in the motor vehicle is (are) generally designed so that a specific polarization of the radio wave is preferred for the sent and received signals. Mostly this is the vertical polarization, i.e. the direction of polarization in which the E-vector is aligned vertically. The reason for this is the shortened vertical monopole antennas predominantly used in motor vehicles.

In the mobile radio stations it is mostly loop antennas or monopole antennas or a combination of the two that are used. In the case of monopole antennas helical antennas are preferred above all.

Loop antennas are characterized by their low body effect but generally have a low efficiency and create a purely linear polarization.

The efficiency of monopole antennas is greater as a rule, however because of the smaller mass counterweight the power transmitted via the antenna is very sensitive to contact however (body effect) This type of antenna too only supports one direction of polarization and also has only one additional zero point in the directional diagram. In mobile radio devices with a lower range monopole antennas which are printed directly onto the circuit board of the device are sometimes used. In this case the body effect is even greater since the entire antenna is generally covered by the hand when the device is being used.

Although antenna arrangements with a combination of loop and monopole antennas make a compromise possible, the characteristic of the one or the other type of antenna predominates depending on where there is contact between the body and the device. In practice the two antennas are connected in parallel, which means that an unbalance of one of the two antennas always also has an effect on the send and receive characteristic of the other antenna in each case. Radiation and reception of electromagnetic waves also occurs in a largely linear polarized manner with these antenna combinations.

For antennas with high efficiency options include structures with a monopole or dipole character. With the conductor dimensions that are acceptable for mobile radio stations, loop structures usually have losses that are too high to be suitable for the coverage required.

With all the previously described types of antenna and possible combinations thereof there are always areas in the directional diagram in which no connection or only an inadequate connection is possible. Apart from the body effect and the so-called zero points in the directional diagram, linear polarization is also above all a problem here. Since as a rule a user decides how to hold the mobile radio station, it is not possible for the manufacturer to match the relative directions of polarization of mobile station and on-board station to each other. Instead it should be assumed that the directions of polarization of the two stations can be in any given orientation to each other if need be. Thus, depending on the direction of polarization, the transmission conditions can differ greatly between mobile radio station and motor vehicle. In the extreme case the directions of polarization of mobile station and on-board station can be at right angles to one another, which means that, despite transmission power being sufficient under usual conditions, there is no communication over relatively small distances.

BRIEF SUMMARY OF THE INVENTION

Using this as its starting point, the object of the invention is to specify an antenna arrangement that makes possible a more reliable transmission of radio signals between a mobile radio station and another radio station.

The object is achieved in accordance with the independent claims of the invention.

The invention comprises an antenna apparatus with a first antenna branch and a second antenna branch, with both the first and the second antenna branch having the form of a non-closed conductor loop and the first antenna branch being arranged in an essentially perpendicular direction to the surface enclosed by the respective conductor loop, spaced in relation to the second antenna branch so that the loop direction determined from the foot point to the free end of the first antenna branch is arranged opposite to the second loop direction determined from the foot point to the free end of the second antenna branch.

The invention further comprises a radio station having said antenna apparatus.

In this context it is pointed out that the terms used in this description and the claims to enumerate features "comprise", "feature", "encompass", "include" and "with" as well as their grammatical variations are generally to be understood as a non-exclusive enumeration of features such as for example method steps, devices, ranges, variables and the like which in no way excludes the presence of other or additional features or groupings of other or additional features.

A corresponding antenna apparatus exhibits a circular-polarized radiation and reception characteristic which makes possible a reliable radio connection independently of the alignment to a radio distant end and has a low body effect. Because of the compact design of the antenna branches in the form of conductor loops, the antenna apparatus is especially suitable for use in small mobile radio devices, the dimensions of which are less than a quarter of the wavelength used to the transmission (e.g. motor-vehicle keys).

The invention is developed in its independent claims.

Preferably the form of the first antenna branch essentially corresponds to the form of the second antenna branch, whereby a defined the embodiment of the E field can be achieved.

The first antenna branch can advantageously be arranged in relation to the second antenna branch so that the location of the first antenna branch is produced from a 180° rotation of the second antenna branch around an axis lying in the longitudinal direction of the device in order to obtain an E-field which is essentially parallel to the H-field.

A compact antenna structure is obtained by the first and the second antenna branch together delimiting a parallelepiped-shaped hollow space, with the parallelepiped-shaped hollow space especially also able to be embodied in the shape of a cuboid. An advantageous reduction in the size of the antenna structure can be achieved in this case if the loop ends of the first and of the second antenna branch each project into one of the delimiting surfaces of the hollow space, or if the end sections of the first and of the second antenna branch are embodied folded back so that they are arranged at a distance from and essentially in parallel to another section of the respective antenna branch.

Alternatively a compact antenna structure can also be achieved when the first and the second antenna branch together delimit a cylindrical hollow space with the first antenna branch and the second antenna branch each being able to be embodied in the form of a helix or a spiral.

The distance between the first antenna branch and the second antenna branch is expediently essentially constant. If necessary the inclination of the first antenna branch and/or of the second antenna branch can be non-constant. The space between the first antenna branch and the second antenna branch can vary in this case along the direction of the loop for optimizing an adaptation of the antenna structure to the housing geometry.

It is useful for the first and the second antenna branch to each be connected at an angle to a foot section. The angle in this case is preferably ninety degrees.

To compensate for non-symmetrical electrical or magnetic stresses on the antenna structure in the device, the strictly symmetrical arrangement of the antenna parts can be departed from, for which purpose the embodiment and/or arrangement of the first antenna branch in relation to the second antenna branch advantageously exhibits at least one deviation from the symmetry.

Further features of the invention emerge from the following description of inventive exemplary embodiments in conjunction with the claims and also with the figures. The individual features can be realized for an exemplary embodiment in accordance with the invention individually or in combination. In the explanation given below of exemplary embodiments of the invention, the reader is referred to the enclosed figures, of which

DESCRIPTION OF THE INVENTION

Figure 1:
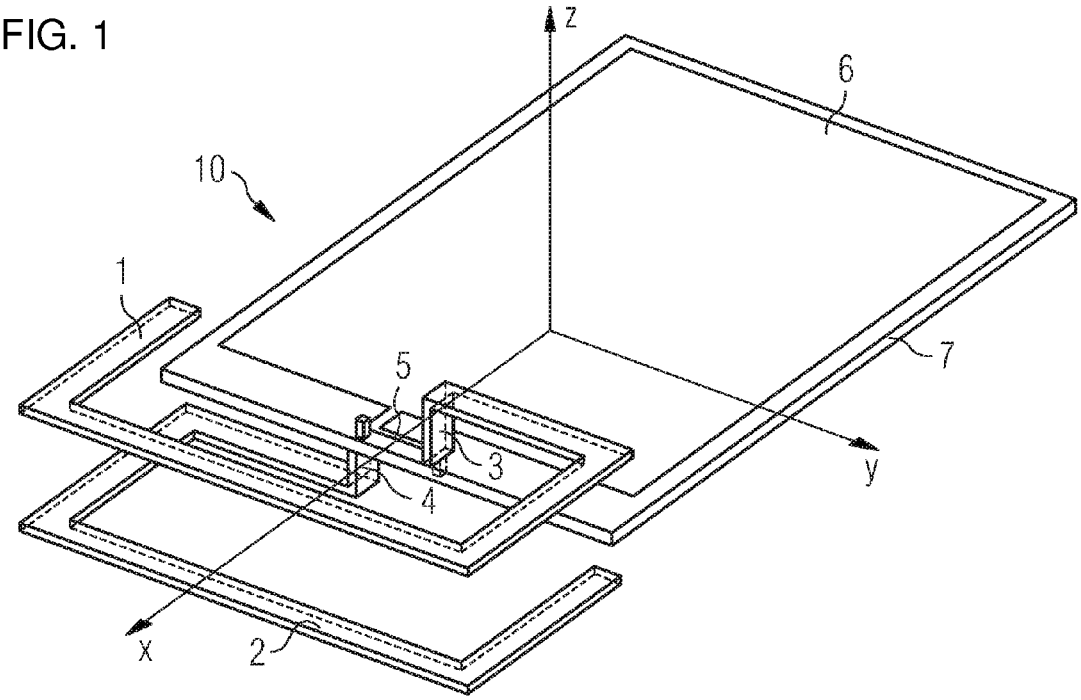
FIG. 1 shows a first exemplary embodiment of an antenna apparatus to create a circular-polarized electromagnetic wave.

FIG. 1 depicts a first exemplary embodiment for an antenna apparatus 10 for creating a circular-polarized far field. The apparatus has two radiator elements which are embodied as first antenna branch 1 and second antenna branch 2. Each of the antenna branches 1 and 2 is attached via a foot section 3 or 4 respectively to a circuit carrier 7, for example a printed circuit board. Generally a circuit of the associated radio station is located on the circuit carrier 7.

Between the foot points of the two foot sections 3 and 4 and electrically connected to these points is arranged the RF feed 5 (not shown in the figure). In the exemplary embodiment shown in FIG. 1 the foot section 4 connected to the second antenna branch 2 is additionally connected to the mass surface of the circuit carrier 7.

The purpose of the foot section 3 and 4 is to keep the antenna branches 1 and 2 at a specific or fixed distance from and in a specific or fixed location relative to the circuit carrier 7 as well as to each other. Preferably the antenna branches are arranged as shown symmetrically to that surface of the circuit carrier 7 on which the foot points of the antenna structure are located.

Basically each of the two antenna branches 1 and 2 forms a non-closed conductor loop. The two conductor loops are arranged in this case in opposite directions to each other, so that in the plan view (in the direction of or opposed to the z-axis), an apparently closed loop structure is produced. In the exemplary embodiments depicted this "closed" loop structure delimits a rectangular surface. If the two antenna branches 1 and 2 are arranged vertically above one another (in the z-direction) as shown in FIG. 1, the conductor loops formed by the two then delimits a rectangular hollow space. If the two antenna branches 1 and 2 (in the z-direction) are arranged above one another offset at an angle however, this hollow space has the shape of a tilted parallelepiped.

Figure 2:
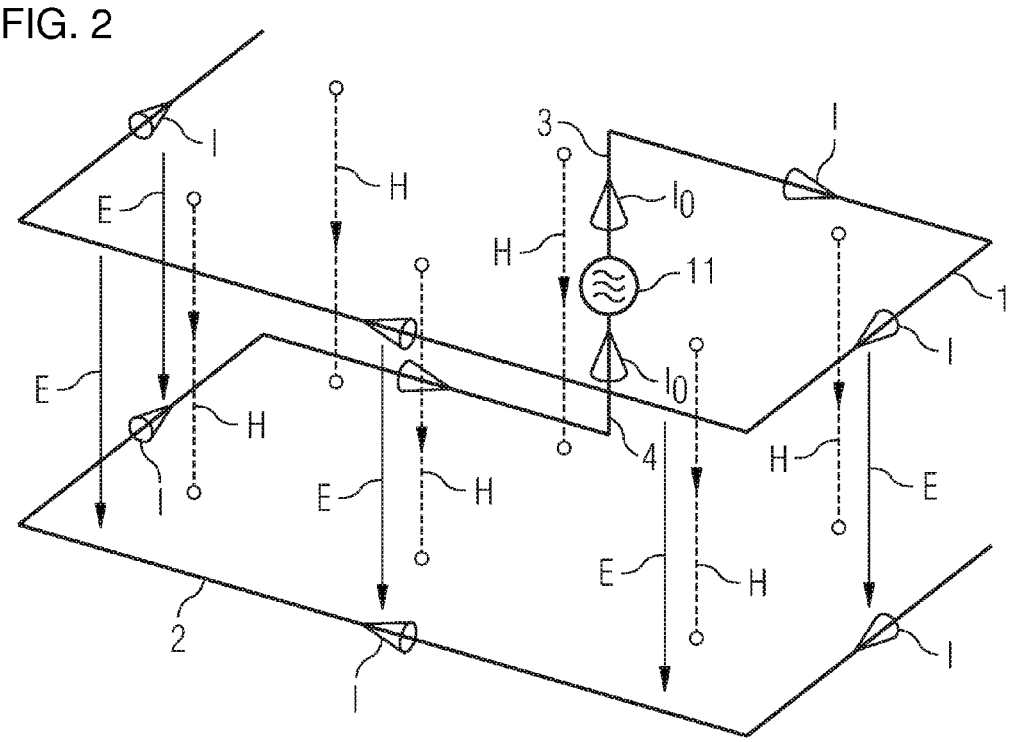
FIG. 2 illustrates the current directions of the antenna apparatus from FIG. 1 and the fields created by it in the near field.

The current distributions to the conductor structures of the antenna apparatus from FIG. 1 and the fields created above these are illustrated in FIG. 2. The first conductor structure of the antenna apparatus is formed by the first antenna branch 1 together with the first foot section 3, the second conductor structure by the second antenna branch 2 together with the second foot section 4. The antenna arrangement is fed via the RF feed 11 which is connected to the foot points of the two conductor structures. The direction of current on the conductor structures is indicated by the arrow heads. The specified current direction is only valid for one of the two half waves of the line-connected wave. With the other half wave the current direction reverses and thereby also the directions of the electrical and magnetic field created. The physical circumstances are the same for both half waves however.

The RF feed 11 charges the two antenna branches 1 and 2 with an opposing polarity, by feeding in the antenna current 10 at the foot points of the conductor structures. The current I flowing in this case in the two branches 1 and 2 adopts different amplitude values along the conductor. The opposing arrangement of the conductor structures means that the magnetic fields created by the current flow in the lower antenna branch 2 and the upper antenna branch 1 are aligned in the same direction, so that the course of the H-field within the hollow space enclosed by the conductor loops has the direction illustrated in FIG. 2 in a first approximation. The different polarity of the two antenna branches 1 and 2 leads to the embodiment of an electrical field E, of which the field lines are indicated in FIG. 2.

In the area of the hollow space enclosed by the conductor loops 1 and 3 as well as 2 and 4, the two fields generated by the current flow I in the antenna branches 1 and 2, i.e. the electrical E field and the magnetic H field, are essentially arranged in parallel to one another. This parallel alignment is also provided in the far field of the antenna arrangement. This means that the resulting E-vectors are at right angles to each other and in accordance with their creation are offset by $\pi/2$ in their phase. As a result the antenna structure depicted in FIG. 1 thus creates a circular-polarized wave which can be received by a linear-polarized antenna structure with low losses oriented in any given way in space. The antenna apparatus 10 from FIG. 1 thus guarantees a polarization adaptation of the signal transmission since an orthogonal alignment of the polarization directions of radio wave and receive antenna is always excluded.

Figure 3:
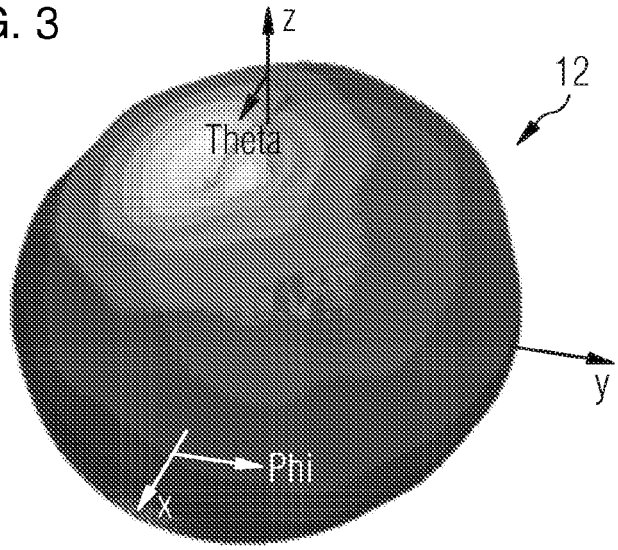
FIG. 3 shows the radiation characteristics of the antenna device of FIG. 1.

The radiation characteristic or the overall gain 12 respectively of the antenna structure 10 from FIG. 1 is reproduced in FIG. 3. An approximately isotropic distribution of the overall gain is apparent. The difference between the maxima (shown darker) and the minima (shown lighter) amounts to only a few dB.

Figure 4:
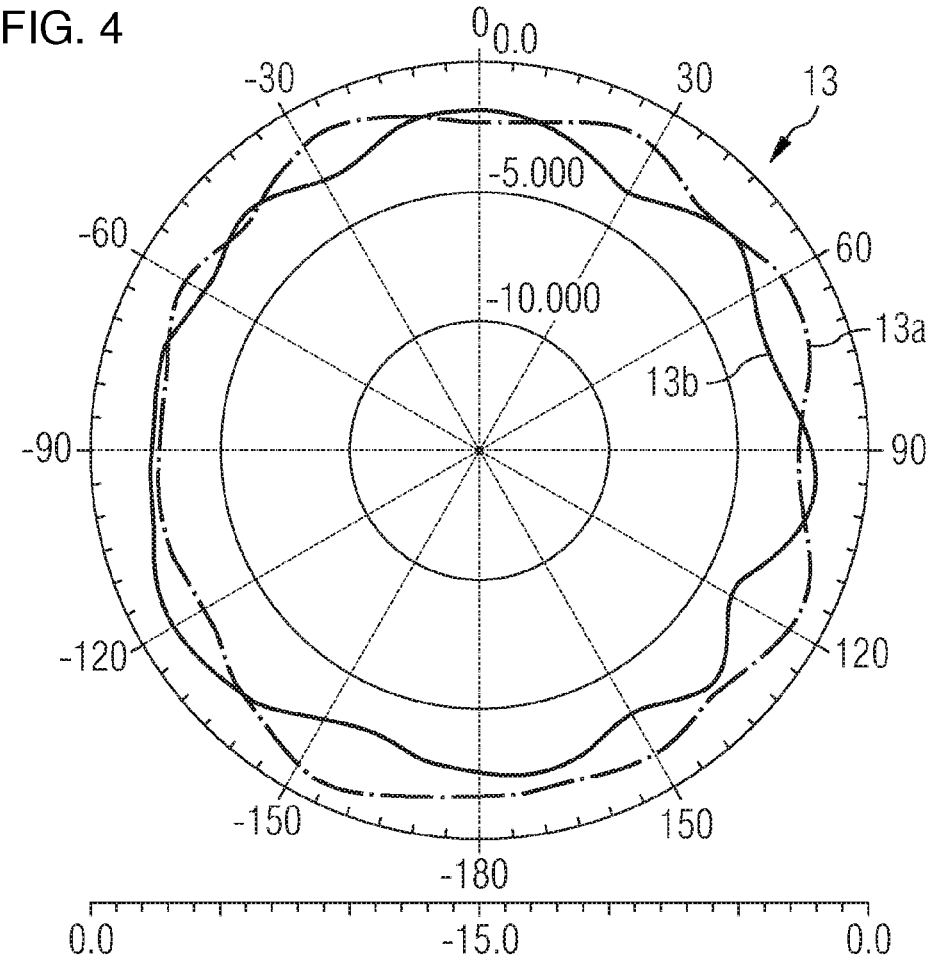
FIG. 4 shows the diagram in the x-y plane of the antenna from FIG. 1.

FIG. 4 shows a diagram computed for the antenna apparatus 10 from FIG. 1 in the x-y plane 13, within which the directional dependencies of the gain for the horizontal polarization (13*a*) and for the vertical polarization (13*b*) are shown. Both curves show a relatively homogeneous distribution. The amplitudes of the two orthogonal field components are almost identical in this case. By appropriate selection of the antenna parameters (specifically by selecting the working frequency slightly away from the inherent resonance) a mutual skewing of the emission directions of the two orthogonal field components can be achieved. This makes it possible to achieve an almost spherical radiation characteristic and thereby to greatly reduce the radiation interruptions in the three-dimensional space.

Figure 5:
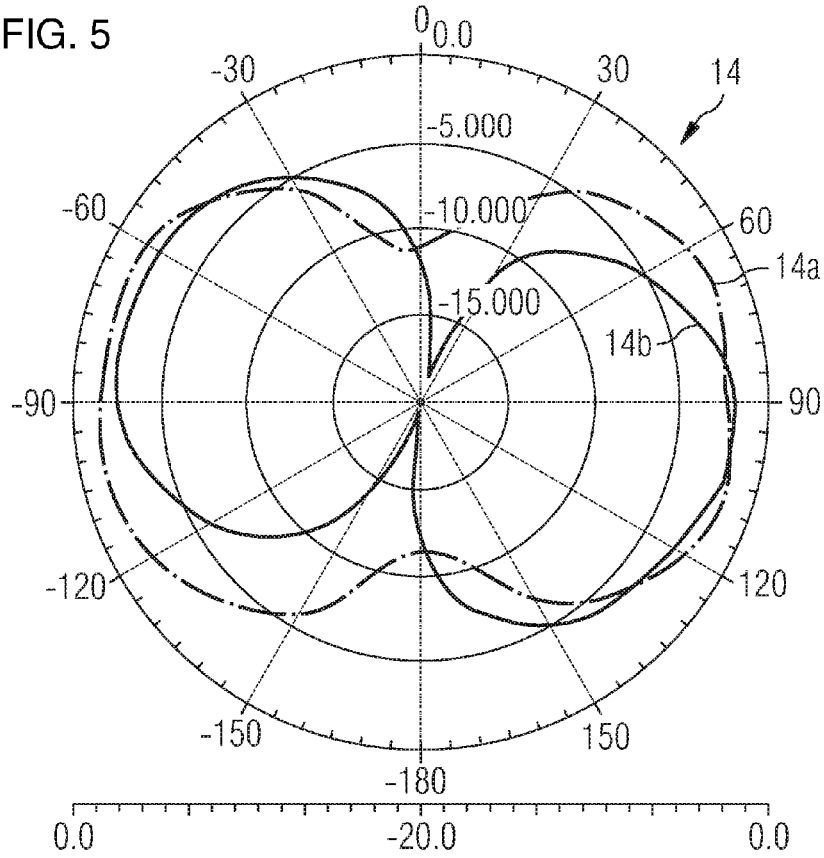
FIG. 5 shows the diagram in the x-z plane of the antenna from FIG. 1.

The direction dependencies of the two wave radiations in the x-z plane are shown in FIG. 5. Diagram 14*a* (horizontal polarization) like diagram 14*b* (vertical polarization) shows a clear cardoidic characteristic, with the maximum radiation power being output at an angle of about ninety degrees rotationally symmetrical around the z-axis. This is similar to the typical behavior of a loop structure in the x-y plane or of a dipole structure in the z-direction.

Figure 6:
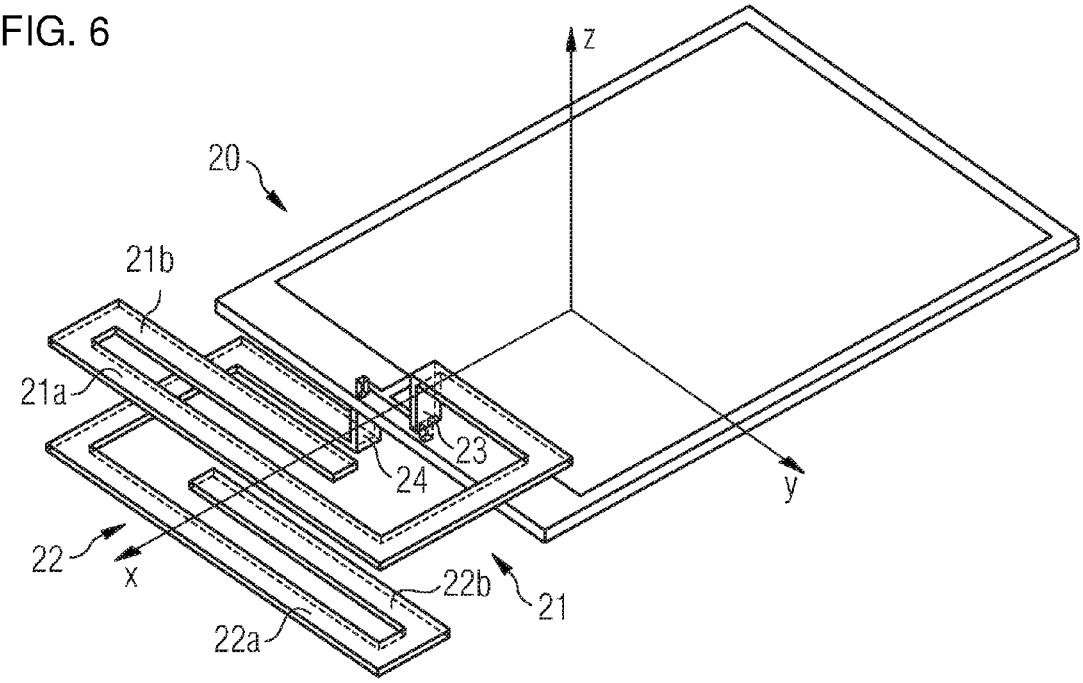
FIG. 6 shows a second exemplary embodiment of an antenna apparatus for creating a circular-polarized electromagnetic wave.

The embodiment of the antenna apparatus 20 from FIG. 6 shows a modified form of the antenna branches from FIG. 1. By contrast to the antenna branches 1 and 2, the free ends 21*b* and 22*b* of the antenna branches 21 or 22 are guided back in the plane of the respective antenna branch, so that the last conductor section 21*b* or 22*b* of an antenna branch is arranged in parallel alongside the conductor section 21*a* or 22*a* located more in the center of the antenna branch. This enables a longer antenna branch to be accommodated on a smaller surface which, with the same length of the antenna branch, produces a smaller antenna volume or conversely, with the same antenna volume, produces a longer antenna branch (more suitable for lower frequencies). Since the current strengths on the antenna branches are unevenly distributed such that they exhibit the greatest amplitudes in the center of the antenna branch, but are practically zero at its ends, the area around the free end of an antenna branch only makes a small contribution to the embodiment of the H-field. The directing back of the ends of the antenna branches shown thus enables a length of the antenna branches appropriate to the respective resonance required in a reduced space, without in this case having to create a negative affect on the radiation characteristic and power of the antenna arrangement.

Figure 7:
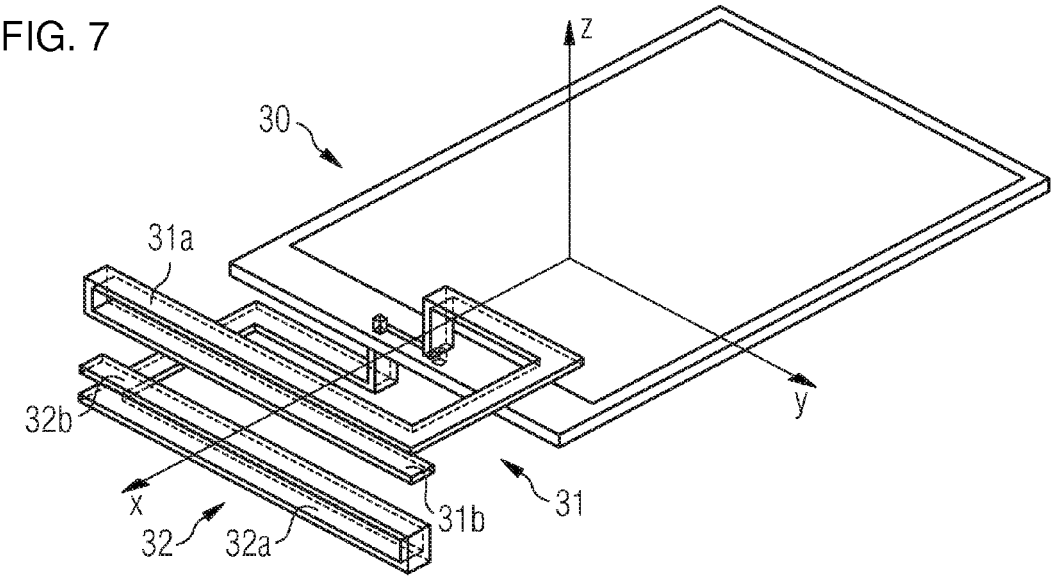
FIG. 7 shows a third exemplary embodiment of an antenna apparatus for creating a circular-polarized electromagnetic wave.

In the exemplary embodiment depicted in FIG. 7 an alternate form of the turning back of the end sections of the antenna branches is presented. By contrast with the previous embodiment, the free ends of the conductor structures are not routed back in the plane of the antenna branch loops in this case. Instead the antenna branches are folded so that the free ends 31*b* and 32*b* on the respective antenna branch 31 or 32 is each arranged below or above its respective center section 31*a* or 32*a*.

Figure 8:
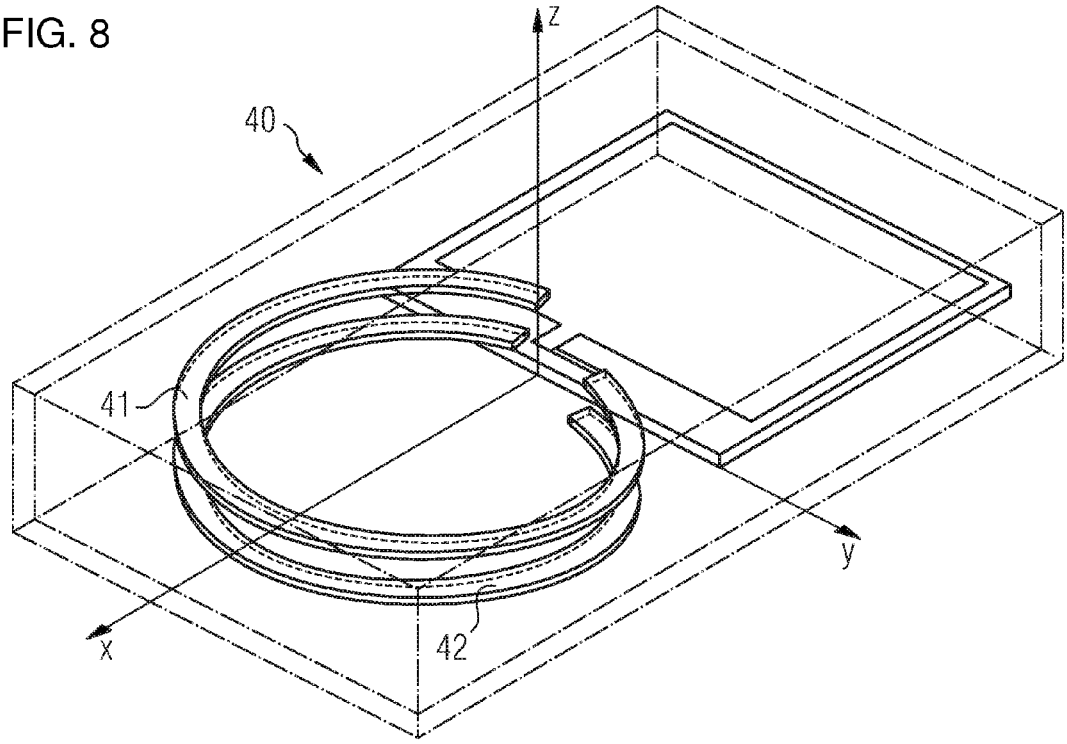
FIG. 8 shows a fourth exemplary embodiment of an antenna apparatus for creating a circular-polarized electromagnetic wave.

FIG. 8 shows a further alternate embodiment 40 of an antenna arrangement for creating a circular-polarized electromagnetic wave. By contrast with the previous embodiments 10, 20 and 30, the two antenna branches 41 and 42 are designed in this diagram in the form of a ring and rest without foot sections directly on the feed points for the RF feed 11. Each of the two antenna branches arranged opposite to one another has the form of a helix, which means that both exhibit an essentially constant vertical spacing (in the z-direction in the figure) over their circumference. The two antenna branches 41 and 42 thus delimit an essentially cylindrical hollow space. Depending on the requirements imposed by the geometry of the device, there can be variations from this structure with constant incline with constant spacing of the antenna branches in the z-direction. The height profile of the antenna structure can be adapted to the space available with almost any given course.

Figure 9:
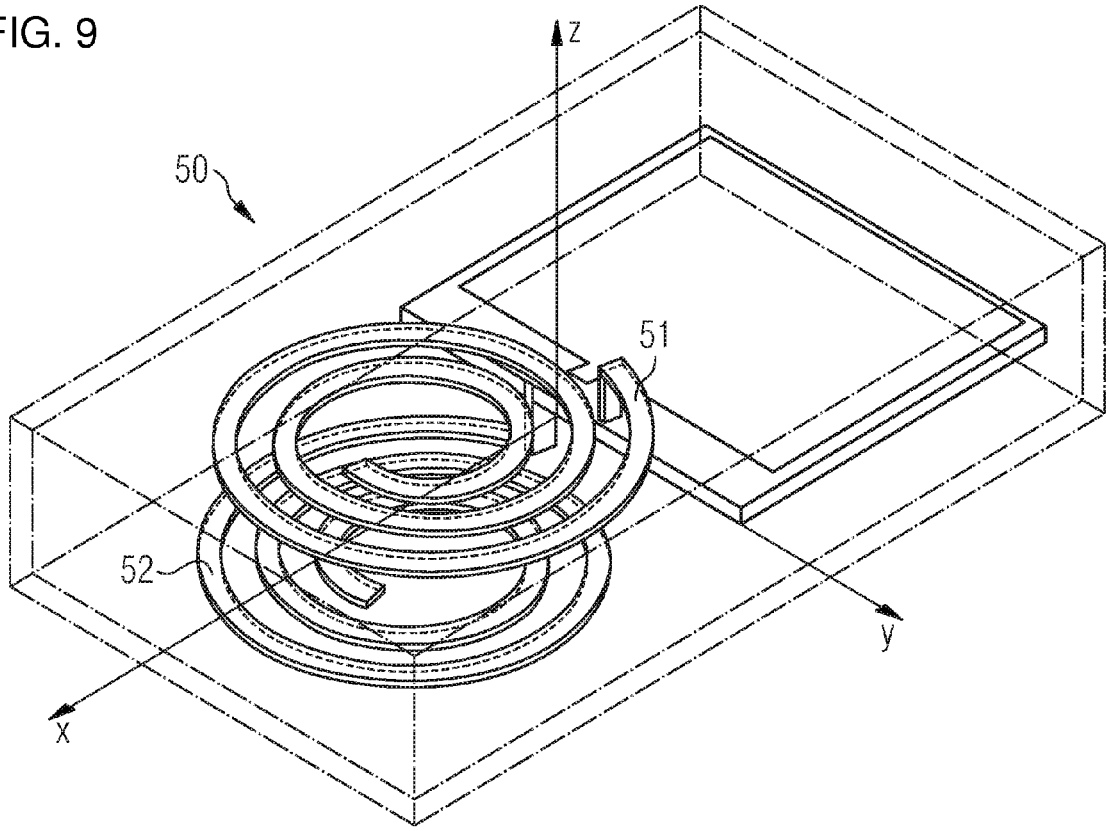
FIG. 9 shows a fifth exemplary embodiment suitable for another frequency range of an antenna apparatus for creating a circular-polarized electromagnetic wave and FIG. 10 shows a sixth exemplary embodiment of an antenna apparatus for creating a circular-polarized electromagnetic wave.

For smaller frequencies with longer wavelengths the spiral-shaped embodiment of the antenna branches 51 and 52 in accordance with the symbol 50 of FIG. 9 is preferred which makes it possible to restrict a ring-shaped geometry of the antenna branches to a small antenna volume. The spacing between the two antenna branches is established as shown using foot sections. The two spiral branches 51 and 52 arranged opposite to one another thus delimit a cylindrical hollow space, with the inner spiral sections of the antenna branches 51 and 52 each being arranged in one of the base surfaces of the enclosed cylindrical volume.

Figure 10:
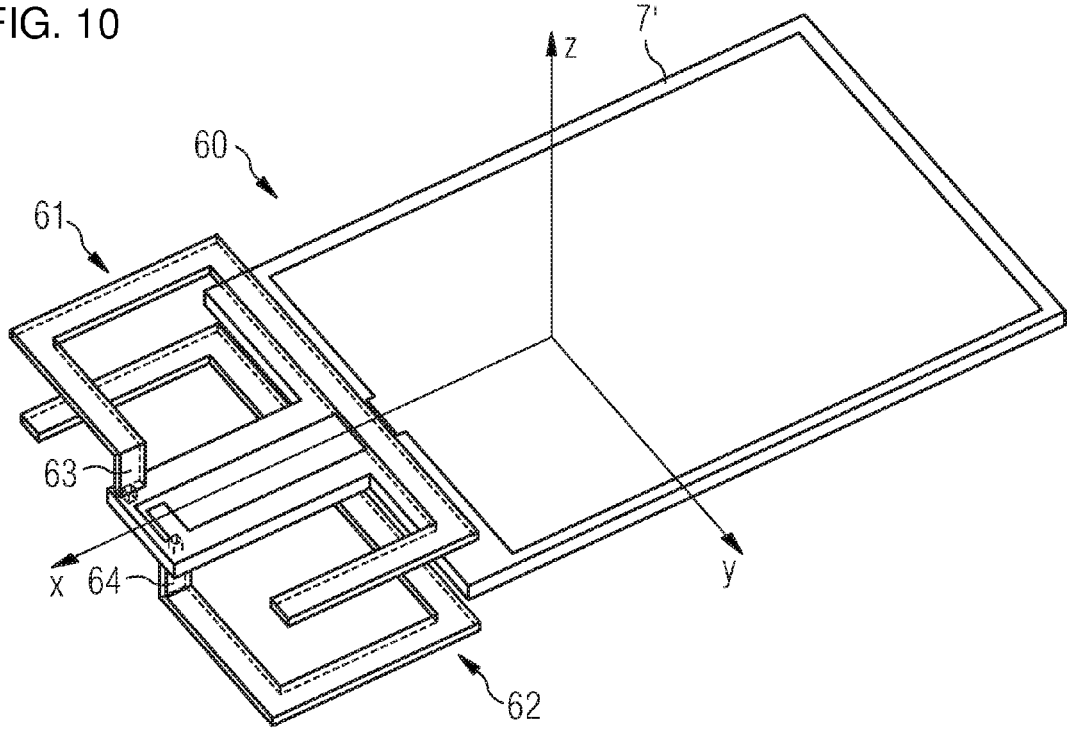

The open ends of the antenna structures shown are very sensitive to being touched because of the high E field. Touching, because of its primarily capacitive effect, causes an imbalance of the antenna The antenna structure 60 shown in FIG. 10 is taken from that shown in FIG. 1 by turning the loop structure formed by the foot sections and the antenna branches by 180 degrees in parallel to the x-y plane. For feeding the radiator elements 61 and 62 via the respective sections 63 and 64 the circuit board 7' is embodied in the shape of a bar in relation to the foot points of the conductor structures. In the exemplary embodiments shown the foot sections essentially connect to the antenna branches at right angles. Other angles can be provided, with a horizontal offset of the two antenna branches (in relation to the x-y plane) able to be achieved in this way.

The common aspect of the exemplary embodiments presented above is that, like a dipole structure, they have two antenna branches, or including the associated foot sections, two conductor loops which essentially possess the same form. The two conductor loops are arranged in opposite directions to each other in that one is in a position which is produced from a rotation of the other by 180 degrees around an axis lying between the two antenna branches, with this axis preferably coinciding with the longitudinal direction of the device which is represented in the figures by the x axis. To compensate for non-symmetrical electrical or magnetic loads on the antenna structure in the device, the design can deviate from the strictly symmetrical arrangement of the antenna parts by the first antenna branch being embodied or arranged slightly non-symmetrical in relation to the second antenna branch.

In this case a non-symmetrical design can be combined with a non-symmetrical arrangement.

LIST OF REFERENCE SIGNS

1 First antenna branch according to first embodiment
2 Second antenna branch according to second embodiment
3 First foot section according to first embodiment
4 Second foot section according to second embodiment
5 Feed
6 Mass surface
7 Circuit carrier/circuit board
7' Circuit carrier/circuit board
10 Antenna apparatus according to the first embodiment
11 RF feed
12 Radiation characteristic of the antenna arrangement according to first embodiment
13 Horizontal diagram of the antenna arrangement according to first embodiment
13*a* Horizontal diagram of the H-field excited wave
13*b* Horizontal diagram of the E-field excited wave
14 Vertical diagram of the antenna arrangement according to first embodiment
14*a* Vertical diagram of the H field excited wave
14*b* Vertical diagram of the E field excited wave
20 Antenna apparatus according to first embodiment
21 First antenna branch according to second embodiment
21*a* Central section of the first antenna branch according to second embodiment
21*b* End section of the first antenna branch according to the second embodiment
22 Second antenna branch according to second embodiment
22*a* Central section of the second antenna branch according to second embodiment
22*b* End section of the second antenna branch according to second embodiment
23 First foot section according to second embodiment
24 Second foot section according to second embodiment
30 Antenna apparatus according to third embodiment
31 First antenna branch according to third embodiment
31*a* Center section of the first antenna branch according to third embodiment
31*b* End section of the first antenna branch according to third embodiment
32 Second antenna branch according to a third embodiment
32*a* Center section of the second antenna branch according to third embodiment
32*b* End section of the second antenna branch according to third embodiment
33 First foot section according to third embodiment
34 Second foot section according to third embodiment
40 Antenna apparatus according to fourth embodiment
41 First antenna branch according to fourth embodiment
42 Second antenna branch according to fourth embodiment
50 Antenna apparatus according to fifth embodiment
51 First antenna branch according to fifth embodiment
52 Second antenna branch according to fifth embodiment
60 Antenna apparatus according to sixth embodiment
61 First antenna branch according to sixth embodiment
62 Second antenna branch according to sixth embodiment
63 First foot section according to sixth embodiment
64 Second foot section according to sixth embodiment
I Current in the antenna branches
E Electrical field
H Magnetic field

The invention claimed is:

1. An antenna apparatus, comprising:

a first antenna branch formed in a non-closed conductor loop with a foot point and a free end;

a second antenna branch formed in a non-closed conductor loop with a foot point and a free end; and a first foot section and a second foot section cooperating to keep said first antenna branch a fixed distance away from said second antenna branch;

said conductor loop of said first and second antenna branches each delimiting a plane and said first antenna branch being spaced apart from said second antenna branch in a direction substantially perpendicular to the planes delimited by said conductor loop, and defining a first loop direction, defined from said foot point to said free end of said first antenna branch, opposite a second loop direction, defined from said foot point to said free end of said second antenna branch.

2. The antenna apparatus according to claim 1, wherein a form of said first antenna branch substantially corresponds to a form of said second antenna branch.

3. The antenna apparatus according to claim 1, wherein said first antenna branch is disposed in relation to said second antenna branch such that a rotation about 180° of said second antenna branch, about a given longitudinal axis (x) of the antenna apparatus, places said second antenna branch in congruent relationship with said first antenna branch.

4. The antenna apparatus according to claim 1, wherein said first and second antenna branches together delimit a parallelepiped-shaped hollow space.

5. The antenna apparatus according to claim 4, wherein said first and second antenna branches together delimit a cuboid-shaped hollow space.

6. The antenna apparatus according to claim 4, wherein each said loop end of said first antenna branch and said loop end of said second antenna branch protrudes into one of the delimitation surfaces of the hollow space.

7. The antenna apparatus according to claim 4, wherein said first and second antenna branches are formed with folded-back end sections disposed at a distance and substantially parallel to another section of the respective said antenna branch.

8. The antenna apparatus according to claim 1, wherein said first and second antenna branches together delimit a cylindrical hollow space.

9. The antenna apparatus according to claim 8, wherein said first antenna branch and said second antenna branch are each formed in a helical shape.

10. The antenna apparatus according to claim 9, wherein at least one of said first antenna branch and said second antenna branch are inclined at a non-constant rise.

11. The antenna apparatus according to claim 8, wherein said first antenna branch and said second antenna branch are each formed in a spiral shape.

12. The antenna apparatus according to claim 1, wherein a distance between said first antenna branch and said second antenna branch is substantially constant.

13. The antenna apparatus according to claim 1, wherein a distance between said first antenna branch and said second antenna branch varies along a direction of said conductor loop.

14. The antenna apparatus according to claim 1, wherein said first antenna branch and said second antenna branch are connected to and enclose an angle with a respective foot section.

15. The antenna apparatus according to claim 14, wherein said angle is ninety degrees.

16. The antenna apparatus according to claim 14, wherein said foot section adjoins one end of the respective said antenna branch.

17. The antenna apparatus according to claim 1, wherein said first antenna branch exhibits at least one deviation, in relation to said second antenna branch, with regard to at least one of a symmetry embodiment and an arrangement thereof.

18. A radio station, comprising an antenna apparatus according to claim 1.

19. The antenna apparatus according to claim 1, wherein said first foot section and said second foot section cooperate to keep said first antenna branch at a fixed location with respect to said second antenna branch.

20. The antenna apparatus according to claim 1, wherein said first antenna branch extends only in one plane and said second antenna branch extends only in another plane.

21. The antenna apparatus according to claim 1, wherein said first foot section and said second foot section cooperate to keep said first antenna branch a specific distance away from said second antenna branch.

* * * * *